US005335698A

United States Patent [19]

Berktold et al.

[11] Patent Number: 5,335,698

[45] Date of Patent: Aug. 9, 1994

[54] METHOD OF RESTARTING A LOOM AFTER STOPPAGE

[75] Inventors: Klaus Berktold; Kurt Günther, both of Rüti; Anton Egloff, Galgenen, all of Switzerland

[73] Assignee: Sulzer Rueti AG, Winterthur, Switzerland

[21] Appl. No.: 49,937

[22] Filed: Apr. 20, 1993

[30] Foreign Application Priority Data

Apr. 22, 1992 [EP] European Pat. Off. ..... 92810293.8

[51] Int. Cl.[5] ..... D03D 51/00

[52] U.S. Cl. ..... 139/1 E; 139/99; 139/116.2

[58] Field of Search ..... 139/1 R, 116.2, 291 R, 139/1 E, 109, 110, 99

[56] References Cited

U.S. PATENT DOCUMENTS

| | | | |
|---|---|---|---|
| 4,605,044 | 8/1986 | Sakano | 139/1 E X |
| 4,942,908 | 7/1990 | Imamura | 139/1 E X |
| 4,964,031 | 10/1990 | Gotoh | 139/1 R X |
| 5,090,452 | 2/1992 | Dondi Benelli | 139/116.2 X |
| 5,224,520 | 7/1993 | Shinbara et al. | 139/116.2 |

FOREIGN PATENT DOCUMENTS

| | | |
|---|---|---|
| 0119121 | 9/1984 | European Pat. Off. . |
| 3642913A1 | 8/1988 | Fed. Rep. of Germany . |
| 2169749 | 6/1990 | Japan . |

*Primary Examiner*—Andrew M. Falik

*Attorney, Agent, or Firm*—Townsend and Townsend Khourie and Crew

[57] ABSTRACT

A method of restarting a loom after an interruption in the weaving process. A cloth fell (15) is moved from an operative or beating position (15) to a second position (15') away from a sley (4). The weft yarn is prevented from being fed into a shed (20) and the loom is then driven in a idling motion for a number of weaving cycles. A shed forming motion 3 and at least one of the warp let-off motion 10 and the cloth take-up motion 12 are driven independently of the predetermined weaving program. When the loom has reached its original dynamic operative state and the warp threads are at the original operative tension, the cloth fell is advanced to the beating position of the sley and the loom is restarted according to the predetermined weaving program. This method prevents visible points of start from occurring in the fabric because of the interruption in the weaving process.

13 Claims, 1 Drawing Sheet

METHOD OF RESTARTING A LOOM AFTER STOPPAGE

BACKGROUND OF THE INVENTION

The invention is concerned with a method of starting a loom after a phase at standstill, in particular after an interruption of the weaving process for the purpose of removal of a fault in the formation of the fabric. The conventional loom comprises a warp let-off motion, a cloth take-up motion, a shed-forming motion and a sley for beating up against the fell of the cloth a weft yarn inserted at any time into a shed.

According to known methods, the fell of the cloth is held at the time in an alternative position at a distance forward from the beat-up position of the sley until a certain beat-up force is reached (Japanese Patent Publication 2-169749). The full beat-up force is, as a rule, reached in the second weaving cycle so that, in the case of the known execution the weft insertion may be effected already after the first weaving cycle executed running idly. In the production of sensitive fabrics, e.g., light-weight fabrics for ladies' outerwear, upon restarting the loom for continuation of the interrupted weaving process, visible points of start may occur in the fabric. It has been found that through the measures known hitherto, in particular in the case of looms of high r.p.m. and correspondingly high weft insertion power, the formation of such starting points cannot reliably be prevented.

The problem underlying the invention is to create a method of starting a loom which is improved in particular in this respect, especially for restarting after the removal of an operative disturbance has been effected, and through which even in the case of looms of high weft insertion power the formation of starting points in the fabric is reliably avoided.

SUMMARY OF THE INVENTION

Applicant's method includes the steps of moving the fell from its operative position, where the sley is positioned to beat the weft yarn, to an alternative position closer to the cloth take-up roller. The weft yarn is then prevented from being fed into the shed and the loom is driven in idling motion so that the shed-forming motion operates in an open position and one of either the warp let-off motion and/or the cloth take-up motion is driven independently of the predetermined weaving program.

The tension of the warp threads and other dynamic operating conditions such as the speed of the loom are monitored with monitoring devices. The loom is driven through a number of weaving cycles (from 2 to 20) until the loom has reached the same warp thread tension and operating conditions as it had prior to stoppage (according to the predetermined weaving program). During these weaving cycles, the fell is slowly moved back to the operational position by changing the speed and direction of the warp beam and the cloth take-up roller. Once the dynamic operating conditions are reestablished, the fell is completely moved to the operational position and the loom is restarted according to the predetermined weaving program.

The energizing of the shed-forming motion and of at least one of the warp let-off and cloth take-up motions independently of the weaving program in the manner in accordance with the invention, allows deliberate influencing of those parameters decisive for uniform formation of the fabric. In particular, the tension of the warp threads which existed before the interruption of the weaving process can be reproduced before the loom has reached its original r.p.m. corresponding with the normal weaving operation and its corresponding dynamic operative state resulting from the cooperation of the individual units. Because of a control signal from an ordinary monitoring device on the loom, which is triggered upon reaching this operative state, the shed-forming motion and the units cooperating with it may be switched over at any time, i.e., after any weaving cycle executed running idly, to the operative weaving program for the initiation of the second phase of the start of the method in accordance with the invention.

Further details follow from the following description of an embodiment of the invention shown diagrammatically in the drawing, in combination with the claims. There is shown in:

DESCRIPTION OF THE PREFERRED EMBODIMENT

Figure 1:
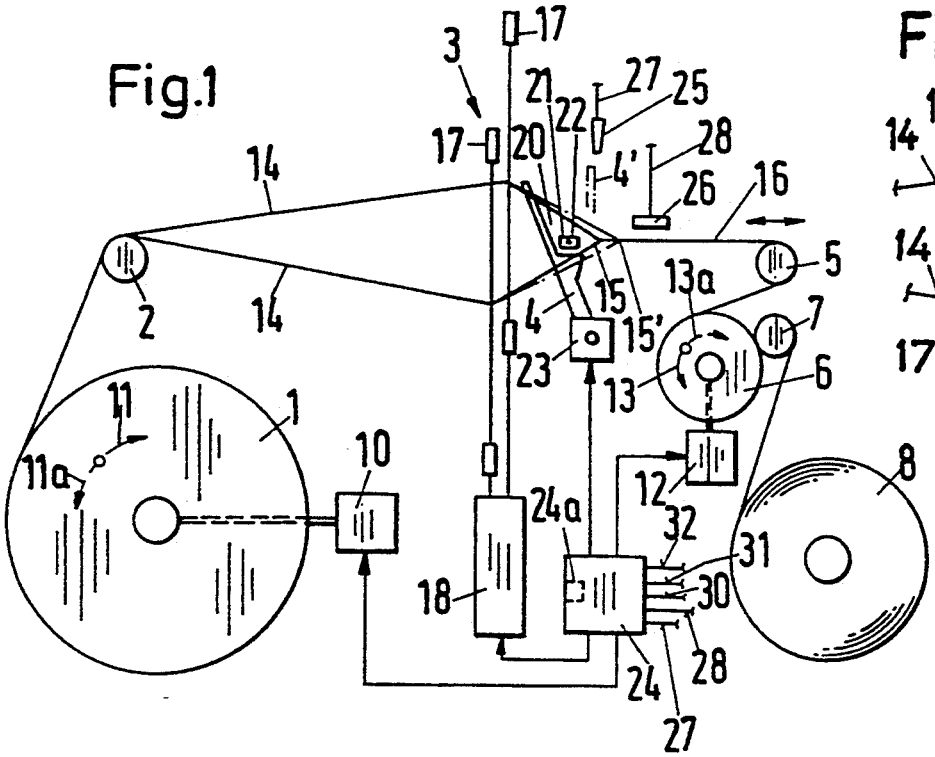
FIG. 1 illustrates parts of a loom suited to the performance of the method in accordance with the invention, in a simplified side elevation.
Figure 1A:
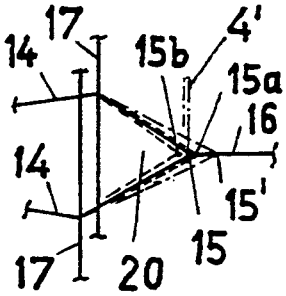
FIG. 1*a* shows an expanded view of the loom set for a form of execution of the method in accordance with the invention.

The loom according to FIG. 1 comprises a warp beam 1, a strain beam 2, a shed-forming motion 3 and a sley 4, as well as a breast beam 5, a cloth take-up roller 6, a pressure roller 7 and a cloth beam 8. The warp beam 1 is coupled to a warp let-off motion 10 which may be driven according to the arrows 11 and 11*a*. In a corresponding way, the cloth take-up roller 6 is coupled to a cloth take-up motion 12 which may be driven according to the arrows 13 and 13*a*. From the warp beam 1, warp threads 14 are led through the shed-forming motion 3 towards a fell 15 of the cloth and from this as part of a fabric 16 being formed there towards the cloth beam 8 upon which the fabric 16 is being wound. The shed-forming motion 3 comprises a number of healds 17, of which only two are represented in the drawing, and a driving mechanism 18 by which the healds 17 are adjustable at any time for the formation of a shed 20.

Via a weft insertion motion (not shown) coupled to the main loom drive and by a means of weft insertion, e.g., compressed air or as indicated in the drawing a gripper element 21 in the form, e.g. of a belt, a weft yarn 22 is inserted into the shed 20 and in a position 4' of the sley 4 in beat-up, into which it may be swung via a driving mechanism 23, is beaten up against the fell 15 of the cloth and bound in through a succeeding change of shed.

The drives of the warp let-off motion 10 and cloth take-up motion 12 as well as the driving mechanism 18 of the shed-forming motion 3 may be energized each on its own via a common control equipment 24 to correspond with a weaving program. The driving mechanism 23 of the slay 4 may be coupled to the main loom drive or, as shown, may be driven by the control equipment 24. In a known manner, via signal leads 27, 28, 30, 31, 32 indicated in the drawing, the control equipment 24 may be influenced by control signals from numerous monitoring devices by which, e.g. the tension of the warp threads 14 and of the weft yarn 22, as well as the state of the fabric 16 being formed, is sensed. In the drawing, a sensor 25 for monitoring the position of the fell 15 of the cloth and a device 26 for detecting a fault in the fabric 16 being formed, e.g. a faultily inserted weft yarn 22, are shown. The sensor 25 and the device 26 are connected to the control equipment 24 via the signal leads 27 and 28, respectively. The drives of the individual units of the loom are matched to one another via the control equipment 24 and during the normal operation of weaving are controlled to correspond with the predetermined weaving program.

Upon the occurrence of a disturbance in operation, e.g., breakage of a warp or weft yarn or a fault in the formation of the fabric, the loom is stopped by a corresponding control signal from the monitoring element in question. If necessary, e.g., for the removal of a faultily inserted wert yarn, the loom can be reversed by resetting the corresponding units—the warp let-off motion 10, the cloth take-up motion 12 and the shed-forming motion 3—into an operative position determined for the continuation of the interrupted weaving process in accordance with the program.

To restart the loom after the removal of the disturbance, the warp beam 1 and the cloth take-up roller 6 are driven step by step (according to the arrows 11 and 13) to move the fell 15 of the cloth out of the position represented in solid line into an alternative position 15' shown in dotted lines, at a distance from the position 4' of the sley 4 in beat-up. The fell 15 is held in this position during part of a first phase of the start. The position of fell 15 is adjusted by adjusting the speed and direction of the warp beam 1 and/or the cloth take-up roller 6. In this first phase of the start, the main loom drive (not shown) connected operatively to at least one unit of the loom, e.g., the weft insertion motion, may be started first and subsequently at least one of the remaining units at a time—the shed-forming motion 3, the warp let-off motion 10 and the cloth take-up motion 12 as well if necessary as the sley 4—chosen to be switched on one after another. The loom—with the weft yarn feed to the weft insertion means 21 blocked—is accordingly driven during a number, e.g., two to twenty or more weaving cycles running idly, until it has reached its original r.p.m. corresponding with normal weaving operation, the original tension of the warp threads 14 has been reproduced and all of its units are cooperating in the corresponding original rhythm.

Figure 3:
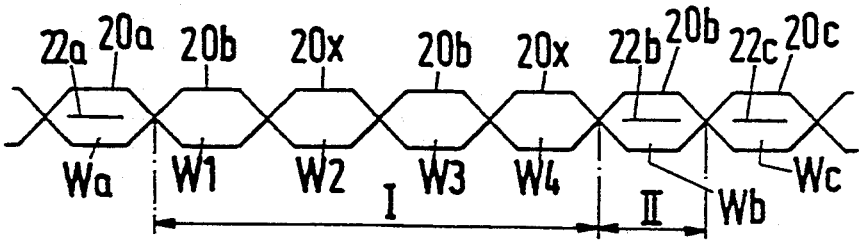
FIGS. 3 and 4 show corresponding shed diagrams of the loom, each according to a further embodiment.
Figure 4:
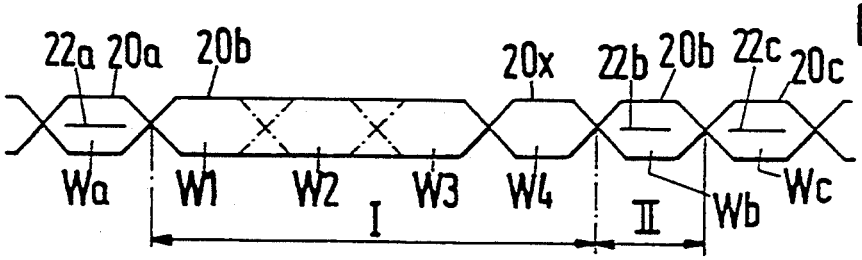

During this first phase of the start, the shed-forming motion 3 is driven by the control equipment 24 independently of the preplanned weaving program, in such a way that in each of the weaving cycles executed running idly, the healds 17 adopt a position which corresponds with an open position of the shed 20 in which the last weft yarn 22 correctly inserted is being held securely bound in by the warp threads 14 at the fell 15 of the cloth in the alternative position 15'. Depending upon the kind of fabric to be produced, the healds 17 (corresponding with the representation according to FIG. 2) may be held over all of the weaving cycles of the first phase of the start in the same open shed position or, as shown in FIGS. 3 and 4, be controlled according to a starting program of their own which deviates from the operative weaving program. When the conditions of operation necessary for continuation of the operative weaving process have been fulfilled, upon a corresponding control signal from at least one of the monitoring devices of the loom, e.g., the device 26 associated with the fabric 16 or a monitoring device (not shown) which picks up the tension of the warp threads 14, a reverse turning of the warp beam 1 and/or of the cloth take-up roller 6 is initiated and the fell 15 of the cloth is carried back towards the position 4' of the sley 4 at beat-up.

In the second phase of the start, the shed-forming motion 3, the warp let-off motion 10 and the cloth take-up motion 12 are reenergized to correspond with the operatively predetermined weaving program in the sense of a continuation of the interrupted weaving process. The weft yarn 22 is delivered to the weft insertion means 21, inserted into the shed 20 formed to correspond with the weaving program, beaten up against the fell 15 of the cloth and bound in through a change of shed following in accordance with the program. Due to the method of starting in accordance with the invention, this weft insertion is effected at the same warp yarn tension and under the same dynamic operative conditions as the weft insertion executed before the interruption of the weaving process, formation of a visible starting point in the fabric may in most cases be reliably avoided.

In certain cases, e.g., in the production of extremely thin, nearly transparent fabrics it has been found that, depending upon the yarn material which is to be processed, streaks can occur in the fabric in the case of the weft insertions which follow the first weft insertion after the second phase of the start. This can occur even when all of the previously mentioned units of the loom have reached the operative state necessary to the normal weaving operation and the tensions of the warp threads as well as the r.p.m. of the loom and all the other parameters agree with the corresponding values before the interruption of the weaving process. In order also to prevent these streaks, the fell 15 of the cloth, which has been moved back from the alternative position 15' at the end of the first phase of the start, may be carried and held in a compensating position **15*a* or 15*b* which is offset with respect to a desired position corresponding with the position 4' of the sley 4 at beat-up. The compensating position 15*a* or 15*b* is offset by an underdimension in the position 15*a* or a corresponding overdimension respectively in the position 15*b***.

This dimension of the offset corresponds with a definite fraction, e.g. , 20 to 60%, of the feed of warp and fabric determined by the weaving program and to be executed after each weft insertion. It may in each case, e.g., to correspond with the properties of the material of the warp and/or weft yarn which is to be processed, be influenced by the warp let-off motion 10 and/or the cloth take-up motion 12 or by appropriate energizing of the strain beam 2 and/or breast beam 5. After the first weft insertion executed in the second phase of the start, the fell 15 of the cloth is carried from the compensating position **15*a* or 15*b*** in a predetermined number of equal partial steps (one to ten or more), in each case before one of the following weft insertions, into a corresponding intermediate position and finally into the desired position.

In this way, the weft density of the fabric 16, determined by the set warp and cloth feed and operatively kept constant, may be varied within the predetermined limits. This type of fell typically arises in the fabric when, at constant weft density, the angles of wrap of the warp threads as they wrap round the weft threads deviate from a desired value set in the case of normal weaving operation. Hence, different angles of wrap of the warp threads wrapping round the weft threads may be compensated and approximated in steps to the operatively desired value of this angle of wrap. The occurrence of a visible point of start in the fabric 16 may accordingly be prevented and an essentially uniform formation of the fabric achieved.

The direction and dimension of the offset necessary at any time in the compensating position 15*a* or 15*b* with respect to the beat-up position 4' of the sley 4 may, e.g., upon starting weaving with the loom occupied by the corresponding warp and weft yarn material, be determined through experimentally executed starting processes of the loom, and set to correspond with the result which may be achieved doing so. By corresponding programming of the control equipment 24, the described correction of the position of the fell of the cloth may, e.g., by energizing the strain beam 2 and/or the breast beam 5, be performed at any time automatically.

For the control of the shed-forming motion 3 during the first phase of the start, an independent control unit 24*a* may be activated during the first phase of the start and switched off before the start of the second phase of the start. The control unit 24*a* may also be made as a component which may at option, say, for the reequipping of an existing loom, be built into an existing control equipment. Instead of the shed-forming motion 3 with healds 17 as described, another shed-forming motion, e.g., a Jacquard motion, may also be provided.

Figure 2:
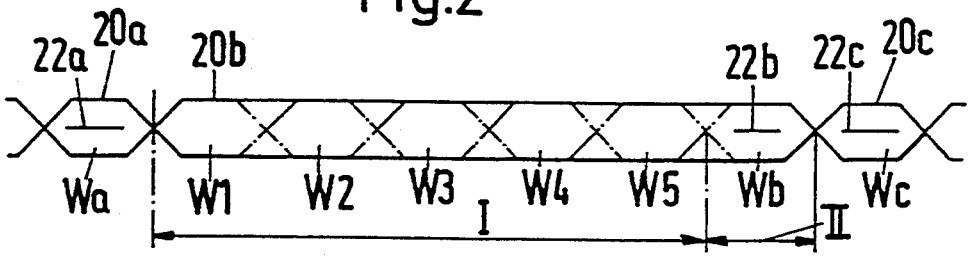
FIG. 2 shows a shed diagram of the loom during the starting phase of the method in accordance with the invention.

The shed diagram according to FIG. 2 shows a shed 20*a* with a weft yarn 22*a* inserted in a weaving cycle Wa before the interruption of the weaving process. A shed 20*b* is formed to correspond with the predetermined weaving program for the next weft insertion, with a weft yarn 22*b* inserted in a weaving cycle Wb. A succeeding shed 20C is formed in accordance with the program, with a weft yarn 22*c* inserted in a weaving cycle We. Over a number of weaving cycles executed running idly (W1–W5), as well as in the weaving cycle Wb of the second phase of the start, the shed 20*b* is held in the open position in which the weft yarn 22*b* is inserted in accordance with the program.

As appears from FIG. 3, the first phase of the start may extend over a number of weaving cycles running idly, in accordance with W1 to W4, with the previously described shed 20*b* being formed in the weaving cycles W1, W3 and Wb, while in each of the weaving cycles W2 and W4 another shed 20*x* is formed which does not occur in the operative weaving program, so that the weft yarn 22*a* is held securely bound in.

According to FIG. 4, the shed 20*b* may be held in the corresponding open position over a number of weaving cycles running idly (W1, W2 and W3), and combined with the shed 20*x* formed in the weaving cycle W4 running idly.

We claim:

1. A method of restarting a loom after a stoppage, the loom having a predetermined weaving program and comprising a warp let-off means, a cloth take-up means, a shed-forming means, a sley for beating up a weft yarn inserted into a shed and a fell, the method comprising the steps of:

moving the fell from a first position, where the sley is positioned to beat the weft yarn, to a second position removed from the first position;

preventing the weft yarn from being fed into the shed;

driving at least one of the shed-forming means, the warp let-off means and the cloth take-up means through a plurality of weaving cycles independently of the predetermined weaving program;

moving the fell from the second position towards the first position during said weaving cycles, the fell being moved by at least one of the warp let-off means and the cloth take-up means;

restarting the loom according to the predetermined weaving program when the fell returns to the first position; and the shed-forming means being held in an operative position corresponding with an open position of the shed for at least a portion of said weaving cycles.

2. A method of restarting a loom after a stoppage, the loom having a predetermined weaving program and comprising a warp let-off means, a cloth take-up means, a shed-means, a sley for beating up a weft yarn inserted into a shed and a fell, the method comprising the steps of:

moving the fell from a first position, where the sley is positioned to beat the weft yarn, to a second position removed from the first position;

preventing the weft yarn from being fed into the shed;

driving at least one of the shed-forming means, the warp let-off means and the cloth take-up means through a plurality of weaving cycles independently of the predetermined weaving program;

moving the fell from the second position towards the first position during said weaving cycles, the fell being moved by at least one of the warp let-off means and the cloth take-up means;

restarting the loom according to the predetermined weaving program when the fell returns to the first position; and the driving step being carried out by driving the shed-forming means according to a starting program which deviates from the weaving program, the shed-forming means being held in an operative position which corresponds with an open position of a second shed not contained in the weaving program in at least one of the weaving cycles. steps of:

3. A method of restarting a loom after a stoppage, the loom having a predetermined weaving program and comprising a warp let-off means, a cloth take-up means, a shed-forming means, a sley for beating up a weft yarn inserted into a shed and a fell, the method comprising the steps of:

moving the fell from a first position, where the sley is positioned to beat the weft yarn, to a second position removed from the first position;

preventing the weft yarn from being fed into the shed;

driving at least one of the shed-forming means, the warp let-off means and the cloth take-up means through a plurality of weaving cycles independently of the predetermined weaving program;

moving the fell from the second position towards the first position during said weaving cycles, the fell being moved by at least one of the warp let-off means and the cloth take-up means;

restarting the loom according to the predetermined weaving program when the fell returns to the first position;

moving the fell into a compensating position offset from the first position by a dimension which corresponds with a definite fraction of a feed of a cloth, the fraction being determined by a control means operatively coupled to the warp let-off means and the cloth take-up means, the fell being moved to the compensating position after the loom has restarted and a first weft yarn has been inserted into the shed; and controllably moving the fell from the compensating position to the first position, the fell being moved a predetermined number of partial steps, each step occurring before a new weft yarn is inserted.

4. A method of restarting a loom after a stoppage, the loom having a predetermined weaving program and comprising a warp let-off means, a cloth take-up means, a shed-forming means, a sley for beating up a weft yarn inserted into a shed and a fell, the method comprising the steps of:

moving the fell from a first position, where the sley is positioned to beat the weft yarn, to a second position removed from the first position;

preventing the weft yarn from being fed into the shed;

driving at least one of the shed-forming means, the warp let-off means and the cloth take-up means through a plurality of weaving cycles independently of the predetermined weaving program;

moving the fell from the second position towards the first position during said weaving cycles the fell being moved by at least one of the warp let-off means and the cloth take-up means;

restarting the loom according to the predetermined weaving program when the fell returns to the first position; and the driving step being carried out by restarting the warp let-off means, the cloth take-up means, the shed-forming means, the sley and a weft insertion means one at a time during each succeeding weaving cycle, the weft yarn being fed into the shed by the weft insertion means after all components in the loom have been restarted.

5. A device for restarting a loom after a stoppage, the loom having a predetermined weaving program and comprising a warp let-off means, a cloth take-up means, a shed-forming means, a sley for beating up a weft yarn inserted into a shed and a fell, the device comprising:

means, operably coupled to the cloth take-up means and the warp let-off means, for moving the fell from a first position, where the sley is positioned to beat the weft yarn, to a second position removed from the first position;

means, operably coupled to the shed, for preventing the weft yarn from being fed into the shed;

a control unit adapted to drive the shed-forming means, the warp let-off means and/or the cloth take-up means through a plurality of weaving cycles independently of the weaving program, the control unit being activated when the loom is stopped;

the warp let-off means and the cloth take-up means being adapted to move the fell from the second position towards the first position during said weaving cycles; and a detector element positioned near the fell to detect a position of the fell, the detector element adapted to emit a control signal to deactivate the control unit when the fell returns to the first position, the loom being restarted according to the predetermined weaving program when the fell returns to the first position.

6. A method for restarting a loom after a stoppage, the loom having a predetermined weaving program with an operational speed and warp threads having an operational tension, the method comprising the steps of:

moving a fell from a first position, where a sley is positioned to beat a weft yarn, to a second position removed from the first position;

preventing the weft yarn from being fed into a shed;

driving the loom in idling motion for a plurality of weaving cycles;

moving the fell from the second position towards the first position while the loom is being driven;

controlling the movement of the fell so that the fell returns to the first position when the loom has reached the operational speed and the warp threads have reached the operational tension; and restarting the loom when the fell returns to the first position.

7. The method of claim 6 wherein a shed-forming means is held in an operative position corresponding with an open position of the shed for at least a portion of said weaving cycles.

8. The method of claim 6 wherein the driving step is carried out by restarting the sley, a shed-forming means, a warp let-off means, a cloth take-up means and a weft insertion means one at a time during each succeeding weaving cycle, each component being driven independently of the predetermined weaving program.

9. The method of claim 8 further comprising the steps of:

moving the fell into a compensating position offset from the first position by a dimension, the dimension being determined by a control means operatively coupled to the warp let-off means and the cloth take-up means, the fell being moved to the compensating position after the loom has restarted and a first weft yarn has been inserted into the shed; and controllably moving the fell from the compensating position to the first position, the fell being moved a predetermined number of partial steps, each step occurring before a new weft yarn is inserted into the shed.

10. The method of claim 8 wherein the controlling step includes the steps of:

monitoring the tension of the warp threads with a monitoring device;

sending a control signal to the warp let-off means and the cloth take-up means when the tension of the warp threads is approximately equal to the operational tension; and adjusting a speed and a direction of at least one of the warp let-off means and the cloth take-up means to move the fell into the first position when the control signal is received.

11. The method of claim 6 wherein the driving step is carried out by driving a shed-forming means according to a starting program, the shed-forming means being held in an operative position which corresponds with an open position of a second shed not contained in the predetermined weaving program in at least one of the weaving cycles.

12. The method of claim 6 wherein the driving step is carried out by driving the loom in idling motion for at least two weaving cycles before the fell is returned to the first position and the loom is restarted.

13. The method of claim 6 wherein the restarting step includes the steps of:

monitoring the position of the fell;

sending a control signal to a control unit when the fell is in the first position;

restarting the loom when the control signal is received; and inserting a new weft thread into the shed after the loom has restarted.

* * * * *